US007111743B1

(12) United States Patent
Moss et al.

(10) Patent No.: US 7,111,743 B1
(45) Date of Patent: Sep. 26, 2006

(54) FOLDABLE STEPPED DISPLAY STANDS

(75) Inventors: Geoffrey Alan Moss, Maple (CA); David Brian Minister, Toronto (CA); Geoffrey Hugh Clifford Moss, Innisfil (CA)

(73) Assignee: Poptech Limited, Toronto (CA)

( * ) Notice: Subject to any disclaimer, the term of this patent is extended or adjusted under 35 U.S.C. 154(b) by 8 days.

(21) Appl. No.: 10/992,247

(22) Filed: Jan. 26, 2005

(51) Int. Cl.
*A47G 29/00* (2006.01)

(52) U.S. Cl. ..... 211/72; 211/72; 211/130.1; 248/174

(58) Field of Classification Search ..... 211/72, 211/128.1, 130.1, 52; 248/152, 154, 174, 248/300; 206/740, 741, 744; 220/6, 62, 220/505, 507, 503
See application file for complete search history.

(56) References Cited

U.S. PATENT DOCUMENTS 1,895,725 A * 1/1933 Nuckols ..... 108/100
1,947,195 A * 2/1934 Flynn ..... 108/100
2,801,754 A * 8/1957 Dorfman ..... 108/100
3,141,555 A * 7/1964 Funke et al. ..... 211/135
4,605,130 A * 8/1986 Taub ..... 211/59.2
4,991,804 A * 2/1991 Iannucci ..... 248/174
6,105,796 A * 8/2000 Buchanan et al. ..... 211/128.1
2003/0062327 A1* 4/2003 Pickett ..... 211/42

* cited by examiner

*Primary Examiner*—Richard E. Chilcot, Jr.
*Assistant Examiner*—Lindsay M. Maguire
(74) *Attorney, Agent, or Firm*—David W. Wong

(57) ABSTRACT

The foldable display stand has a stepped display shelving portion removably mounted over a foldable support base. The shelving portion is formed by folding various parts of a configuration formed on a single sheet material. The configuration includes a plurality of rectangular panels connected by a plurality horizontal fold lines. Side extensions are formed on the two side edges of the rectangular panels which are foldable to form side wall of the shelves and the side walls are mounted in place by mounting tabs formed in the side extensions and mounting slots formed in the selected rectangular panels. Side extensions having a unique design are adapted to form reinforced side walls of the shelves.

4 Claims, 4 Drawing Sheets

FOLDABLE STEPPED DISPLAY STANDS

FIELD OF THE INVENTION

This invention relates to stepped display stands and particularly relates to merchandise display stands including a foldable display having a plurality of shelves in a stepped configuration and removably mounted on a foldable support base.

BACKGROUND OF THE INVENTION

Display stands made of cardboard or corrugated paper board are widely used for showing varieties of merchandises. Such stands are convenient to erect, low cost to produce and providing adequate durability for repeated uses. A stand may also be made by stamping its configuration on a single cardboard and then folding the various parts of the configuration to form the stand having both the display tray and the integral support base. Pictures and various decorations and advertising information may be printed on the stand for attracting the consumers's attention and interest of the merchandise. One drawback of such display stand is that the merchandise is placed within a tray such that it is not visible to the consumers and the merchandise is difficult to be removed from the tray for selection and purchase. Such drawback is alleviated by providing a display portion in the form of a plurality of stepped shelves such that the various items of the merchandise placed on the stepped shelves are clearly visible and may be conveniently selected and removed for examination and purchase.

However, when the display shelves and the supporting base are integrally formed with one single cardboard configuration, it is cumbersome to erect by a single person due to the necessity to fold a plurality of parts while holding some of the parts that have already been folded in order to fold other parts. Furthermore, the entire integral display shelves and supporting base when unfolded to a collapsed condition for storage and transportation is rather bulky for packaging.

SUMMARY OF THE INVENTION

It is a principal object of the present invention to provide a display stand having separate display portion in the form of a plurality of display shelves and foldable support base which may be mounted together quickly and easily.

It is another object of the present invention to provide a display stand having a plurality of display shelves formed with a single configuration on a single cardboard which may be easily erected and unfolded to a collapsed compact condition for storage and transport.

It is another object of the present invention to provide a display stand having a plurality of shelves with reinforced shelves or platforms and side walls.

It is another object of the present invention to provide a configuration for forming a display stand having a plurality of shelves with reinforced platforms with side walls in which decoration or print may be provided on a single surface of the configuration such that when the various parts are folded to form the shelves, the decoration or print will appear on the front surface of the platforms as well as the side walls.

It is another object of the present invention to provide a configuration for forming a display stand having a plurality of shelves with reinforced platforms with side walls in which different decoration or prints may be provided on different parts of the configuration such that when the various parts are folded to form the shelves, various decoration or prints will appear on intended surfaces of the shelves and side walls.

It is yet another object of the present invention to provide a display stand having separate display portion and support base in which the support base is self-erecting.

BRIEF DESCRIPTION OF THE DRAWINGS

Other objects will be in part apparent and in part pointed out hereinafter with reference to the accompanying drawings in which.

DETAILED DESCRIPTION OF THE PREFERRED EMBODIMENTS

Figure 5:
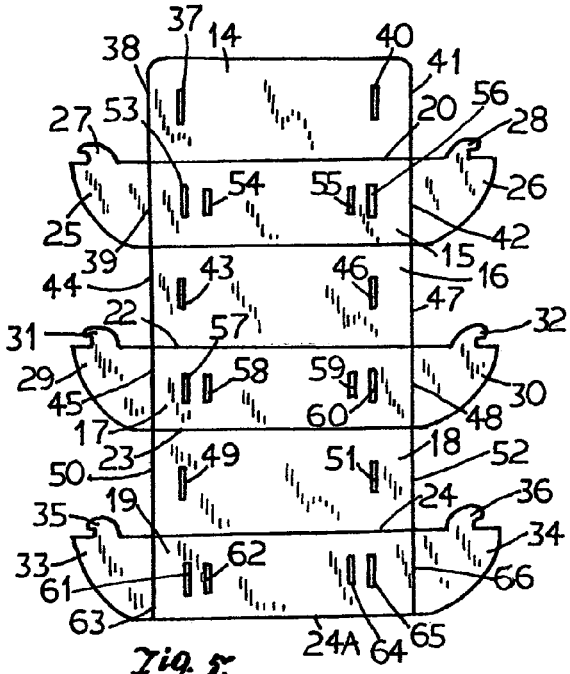
FIG. 5 is a perspective front elevation view of the configuration provided on a cardboard which may be folded to form the display shelving portion of the display stand.

With reference to the drawings in which same reference numerals designate like parts in the various views, the display stand 10 of the present invention comprises of a separate display shelving portion 11 and a support base 12. For simplicity of illustration, a display stand having three stepped shelves is shown as an example. The display shelving portion 11 may be formed by stamping or cutting a configuration 13 as best shown in FIG. 5 having a substantially rectangular top panel 14, second panel 15, third panel 16, fourth panel 17, fifth panel 18 and lower sixth panel 19. A horizontal fold line 20 is located between the top panel 14 and the second panel 15. Similarly, a horizontal fold line 21 is located between the second panel 15 and the third panel 16; a fold line 22 is located between the third panel 16 and the fourth panel 17; a horizontal fold line 23 is located between the fourth panel 17 and the fifth panel 18; and a horizontal fold line 24 is located between the fifth panel 18 and the lower sixth panel 19. Two substantially triangular extension portions 25 and 26 are located at two sides of the top panel 14. Two mounting hooks 27 and 28 are formed at the upper edge adjacent to the outer corner of the extension portions 25 and 26. Similarly, two substantially triangular extension portions 29 and 30 are located at the two sides of the fourth panel 17, and two mounting hooks 31 and 32 are located at the upper edge adjacent to the outer corners of these extension portions 29 and 30; while two substantially triangular extension portions 33 and 34 are located at the two sides of the lower sixth panel 19, and two mounting hooks 35 and 36 are located at the upper edge adjacent to the outer corners of these extension portions 33 and 34.

A vertical slot 37 is located adjacent the left side edge 38 of the top panel 14 and it is directly aligned with the left side edge 39 of the second panel 15. A second vertical slot 40 is located adjacent the right side edge 41 of the top panel 14 and it is directly aligned with the right side edge 42 of the second panel 15. Similarly, a vertical slot 43 is located adjacent the left side edge 44 of the third panel 16 and it is directly aligned with the left side edge 45 of the fourth panel 17, and a vertical slot 46 is located adjacent to the right edge 47 of the third panel 16 and it is directly aligned with the right side edge 48 of the fourth panel 17; a vertical slot 49 is located adjacent the left side edge 50 of the fifth panel 18 and it is directly aligned with the left side edge 45 of the fourth panel 17, and a vertical slot 51 is located adjacent to the right side edge 52 of the fifth panel 18 and it is directly aligned with the right side edge 48 of the fourth panel 17.

A pair of parallel vertical slots 53 and 54 is located adjacent to the left side edge 39 of the second panel 15, and a pair of parallel vertical slots 55 and 56 is located adjacent to the right side edge 42 of the second panel 15. Similarly, a pair of parallel vertical slots 57 and 58 is located adjacent to the left side edge 45 of the fourth panel 17, and a pair of parallel vertical slots 59 and 60 is located adjacent to the right side edge 48 of the fourth panel 17; a pari of parallel vertical slots 61 and 62 is located adjacent to the left side edge 63 of the lower sixth panel 19 and a pair of parallel vertical slots 64 and 65 is located adjacent to the right side edge 66 of the sixth lower panel 19.

Figure 4:
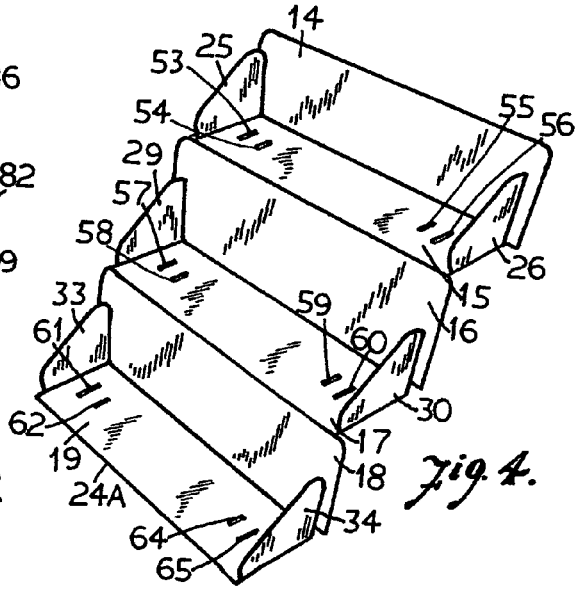
FIG. 4 is a perspective front elevation view of the display shelves portion of the display stand.

The shelving portion 11 may be formed by first folding the top panel 14 upwards along the horizontal fold line 20 until it is perpendicular to the second panel 15. The side extension portions 25 and 26 may also be folded upwards along the side edges 39 and 42 until they are perpendicular to the second panel 15. The mounting hooks 27 and 28 may then be engaged with the vertical slots 37 and 40 respectively to maintain the two panels 14 and 15 in the perpendicular erected condition. Similarly, the third panel 16 may be folded upwards relative to the fourth panel 17 and the extension portions 29 and 30 are folded upwards with their mounting hooks 31 and 32 engaging with the vertical slots 43 and 46 respectively in the third panel 16 to maintain these two panels in the perpendicular erected condition; and the fifth panel 18 is folded upwards with respect to the lower sixth panel 19 and the extension portions 33 and 34 also folded upwards with their mounting hooks 35 and 36 engaging respectively with the vertical slots 49 and 51 to maintain these panels in the perpendicular erected condition. The erected shelving portion 11 is best shown in FIG. 4. The shelving portion 11 may be easily disassembled by disengaging the mounting hooks 27, 28, 31, 32, 35 and 36 from the respective vertical mounting slots 37, 40, 43, 46, 49 and 51, and then folding sequentially the fifth panel 18 over lower sixth panel 19, the fourth panel 17 over the folded fifth panel 18 and sixth panel 19, the third panel 16 over the folded fourth, fifth and sixth panels, folding the second panel 15 over the folded third, fourth, fifth and sixth panels, and lastly folding the top panel 14 over the now folded second, third, fourth, fifth and sixth panels to a compact collapsed condition for storage and transport.

Figure 1:
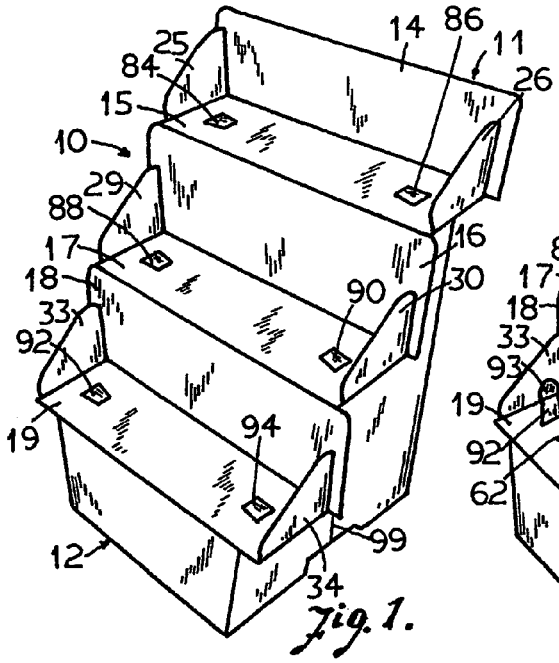
FIG. 1 is a perspective front elevation view of the display stand according to the present invention.
Figure 2:
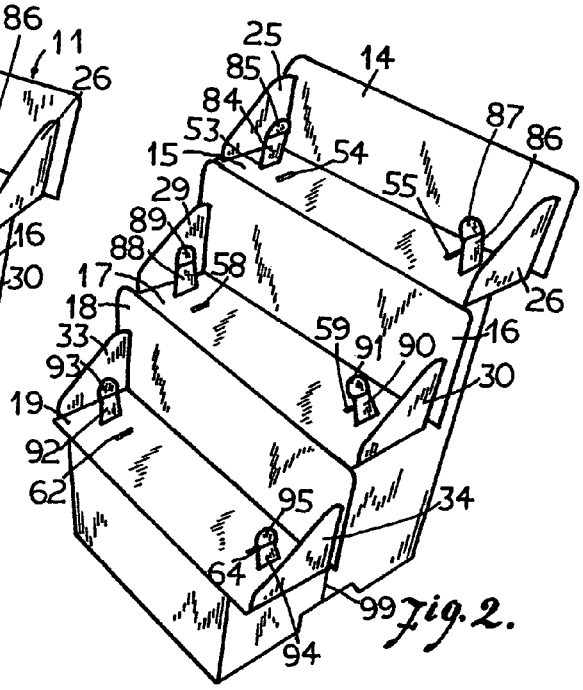
FIG. 2 is a perspective front elevation view of the display stand showing mounting tabs in the unfolded condition which are operative for mounting the display shelves portion and the support base together.
Figure 3:
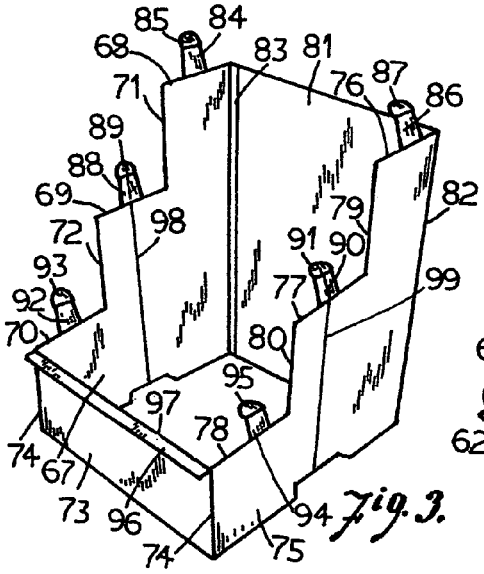
FIG. 3 is a perspective front elevation view of the support base of the display stand.

The support base 12 is also formed with a single configuration stamped with a single piece of cardboard. The configuration has a first panel 67 having horizontal stepped top edges 68, 69 and 70 separated by vertical side edges 71 and 72; a rectangular panel 73 extending sideways from the vertical right side edge 74 of the first panel 67, a third panel 75 which is a mirror image of the first panel 67 and having horizontal stepped top edges 76, 77 and 78 which are separated by vertical side edges 79 and 80; a rectangular fourth panel 81 extending sideway from the vertical right side edge 82 of the third panel 75. An extension vertical mounting edge portion 83 is formed at the left side edge of first panel 67 so that the support base 12 may be fabricated by adhering the extension vertical mounting edge portion 83 with the vertical right side edge of the fourth panel 81 as best shown in FIG. 3. The width of the top edges 68 and 76 are equal to one another as well as the distance between the fold lines 20 and 21 of the shelving portion 12. Similarly, the width of the top edges 69 and 77 are equal to one another as well as the distance between the fold lines 22 and 23 of the shelving portion 12; and the width of the top edges 70 and 78 are equal to one another as well as the distance between the fold line 24 and the lower edge 24A of the lower sixth panel 19.

The height of the vertical edges 71 and 79 are equal to one another as well as the distance between the fold lines 21 and 22 of the shelving portion 12; and the height of the vertical edges 72 and 80 are equal to one another as well as the distance between the fold lines 23 and 24.

A mounting tab 84 extends upwards from the top edge 68 and a mounting free end portion 85 is formed at its upper end portion. Similarly, a mounting tab 86 having a mounting free end portion 87 extends upwards from the top edge 76; a mounting tab 88 having a mounting free end portion 89 extends upwards from the top edge 69; a mounting tab 90 having a mounting free end portion 91 extends upwards from the top edge 77; a mounting tab 92 having a mounting free end portion 93 extends upwards from the top edge 70; and a mounting tab 94 having a mounting free end portion 95 extends upwards from the top edge 78.

A rectangular extension portion 96 may be provided along the upper edge 97 of the rectangular panel 73.

Figure 6:
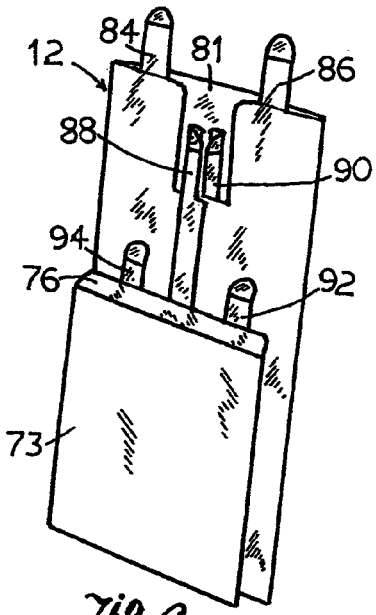
FIG. 6 is a perspective front elevation view of the display stand with both the display shelves portion and the support base in the collapsed folded condition for storage and transport.
Figure 7:
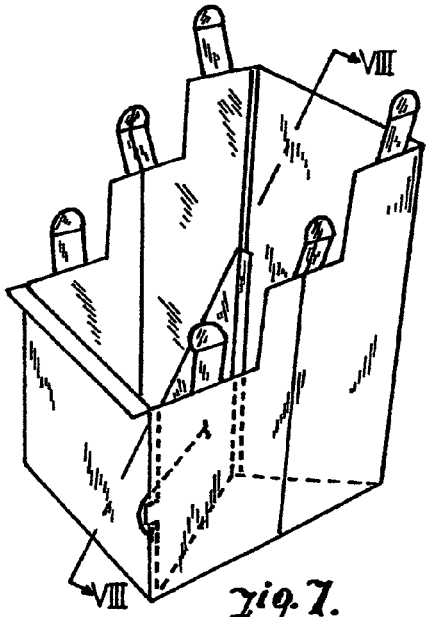
FIG. 7 is a perspective front elevation view of the self-erecting support base.

A vertical fold line 98 is provided at the middle of the first panel 67 as well as the mounting tab 88; and a similar vertical fold line 99 is provided at the middle of the third panel 75 as well as the mounting tab 90. The base portion 12 may be folded to a compact collapsed condition for storage and transport as best shown in FIG. 6 by pushing the stepped panels 67 and 75 towards each other and folding them inwards along the vertical fold lines 98 and 99.

The shelving portion 11 may be easily and quickly mounted on the support base 12 by placing the shelving portion 11 over the latter such that the mounting tabs 84, 86, 88, 90, 92 and 94 engage with the mounting slots 53, 56, 57, 60, 61 and 65 respectively. The shelving portion 11 and the support base 12 may then be fixedly mounted together by inserting the mounting free end portions 85, 87, 89, 91, 93 and 95 into the mounting slots 54, 55, 58, 59, 62 and 64 respectively.

The entire erected stand may be disassembled easily and quickly by simply disengaging the mounting tabs of the support base from the mounting slots of the shelving portion 11 and then folding the shelving portion 11 and support base 12 to the collapsed condition as described above for storage and transport.

Figure 8:
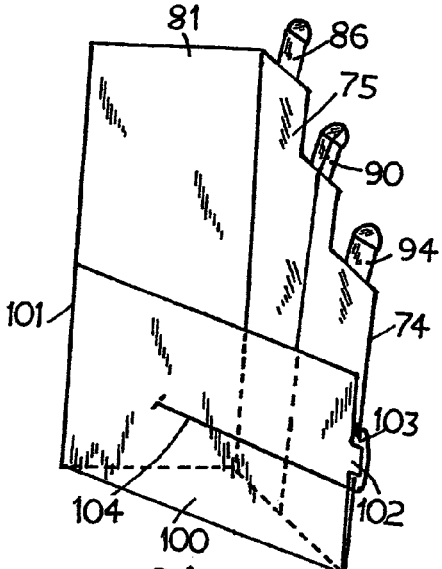
FIG. 8 is a cross sectional perspective elevation view of the self-erecting support base along section line VIII—VIII of FIG. 7.
Figure 9:
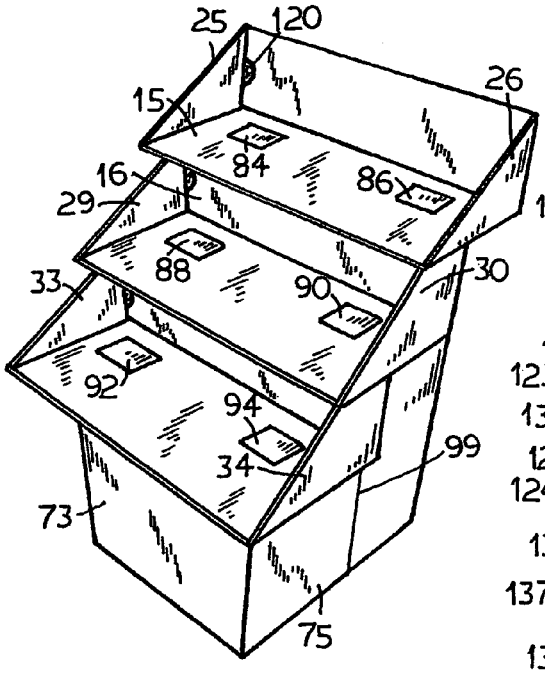
FIG. 9 is a perspective front elevation view of a second embodiment of the display stand having reinforced shelves or platforms and side walls.

A support base 12 may be made self-erecting by providing a pivotal panel 100 mounted in a diagonal manner within the base. A vertical edge 101 of the pivotal panel 100 is mounted at the joined vertical edge between the panels 67 and 81 and it extends to the opposite corner to engage with the fold line 74. An extension tab 102 is formed at its vertical edge adjacent to the fold line 74. The extension tab 102 will engage with a retaining opening 103 formed at the fold line 74, so that in the erected condition the extension tab 102 will engage with the retaining opening 103 to maintain the base in the erected condition. An elastic cord 104 is provided between the pivotal panel 100 and the fold line 74 corner of the support base 12 as best shown in FIG. 8. The support base 12 may be folded to a collapsed condition by pushing the opposite corners of the base outwards to disengage the extension tab 102 from the retaining opening 103 and then also pushing the panels 67 and 75 outwards to fold along vertical fold lines 98 and 99. The elastic cord 104 will be in a tension state when the support base 12 is folded in the collapsed condition so that the support base may be easily erected by merely allowing the tension of the elastic cord 104 to pull the pivotal panel 100 back to the diagonal position to unfold the support base as well as to maintain it in the erected condition.

Figure 10:
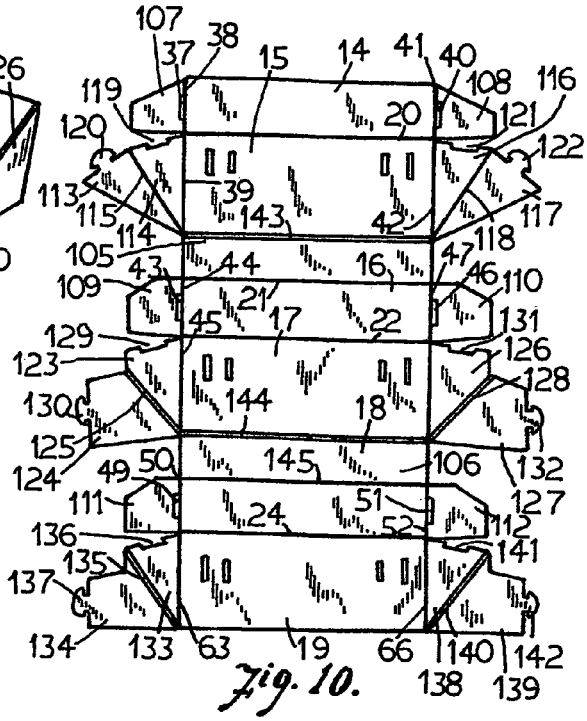
FIG. 10 is a perspective front elevation of the configuration formed on a single cardboard which may be folded to form the second embodiment of the display stand of FIG. 9.

A second embodiment of the shelving portion 11 having reinforced shelves as well as side walls is shown in FIG. 10. The configuration provided in the cardboard for forming the shelving portion 11 includes a first horizontal reinforcing panel 105 located between the second panel 15 and third panel 16, and a second horizontal reinforcing panel 106 is located between the fourth panel 17 and fifth panel 18. Trapezoidal reinforcing side panels 107, 108, 109, 110, 111 and 112 are provided at the side edges 38, 41, 44, 47, 50 and 52 respectively and extending sideways outwardly therefrom. Alternatively, these side panels may have a triangular shape. The mounting openings 38, 40, 43, 46, 49 and 51 are formed in the reinforcing side panels 107, 108, 109, 110, 111 and 112 along the side edges 38, 41, 44, 47, 50 and 52, instead of in the panels 14, 16, and 18 as in the previous embodiment described above, as best shown in FIG. 10.

The extension portion extending sideway from the left edge 39 is further divided into two triangular portions 113 and 114 separated by a common fold line 115. The triangular portion 114 is juxtaposed to the side edge 39 of the panel 15. Similarly, the extension portion extending sideway from the right edge 42 of the panel 15 is further divided into two triangular portions 116 and 117 divided by a common fold line 118. A rectangular cut out 119 is formed at the upper edge of the triangular portion 114 and a mounting tab 120 is provided at the upper edge of the triangular portion 113. The length of the rectangular cut out 119 is equal to the length of the vertical mounting slot 37. Similarly, a rectangular cut out 121 is formed at the upper edge of the triangular portion 116 and a mounting tab 122 is formed at the upper edge of the triangular portion 117.

The extension portion extending sideway from the left edge 45 of panel 17 may have the same configuration as that of panel 15 but it is preferably divided into a triangular portion 123 juxtaposed to the left edge of the panel 17 and an outer trapezoidal portion 124 having a common fold line 125 between them. Similarly, the extension portion extending sideway from the right edge of panel 17 is divided into a triangular portion 126 and an outer trapezoidal portion 127 having a common fold line 128. A rectangular cut out 129 is formed at the upper edge of the triangular portion 123 and a mounting tab 130 is provided at the outer edge of the trapezoidal portion 124, and a rectangular cut out 131 is formed at the upper edge of the triangular portion 126 and a mounting tab 132 is provided at the outer edge of the trapezoidal portion 127.

Similarly, the extension portion extending sideway from the left edge 63 of the lower panel 19 includes a triangular portion 133 and a trapezoidal portion 134 divided by a common fold line 135. A rectangular cut out 136 is formed at the upper edge of the triangular portion 133 and a mounting tab 137 is provided at the outer edge of the trapezoidal portion 134.

The extension portion extending outwards from the right side edge of the panel 19 is divided into a triangular portion 138 and a trapezoidal portion 139 having a common fold line 140. A rectangular cut out 141 is formed at the upper edge of the triangular portion 138 and a mounting tab 142 is provided at the outer edge of the trapezoidal portion 139.

Figure 11:
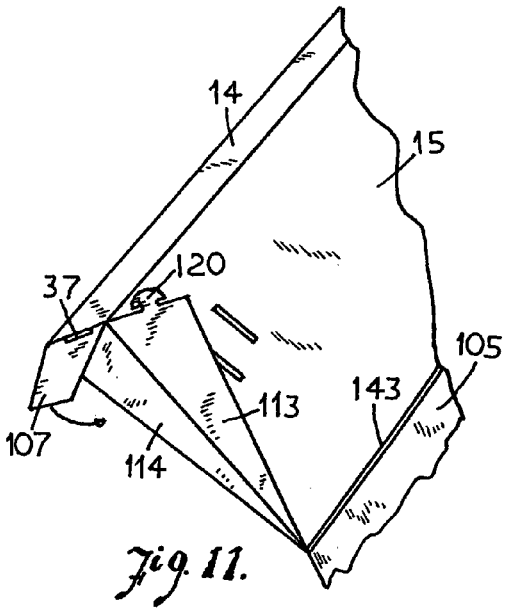
FIG. 11 is an isolated enlarged perspective front elevation view of the top left portion of the configuration showing how it may be folded to form a side wall of the embodiment of FIG. 9.
Figure 12:
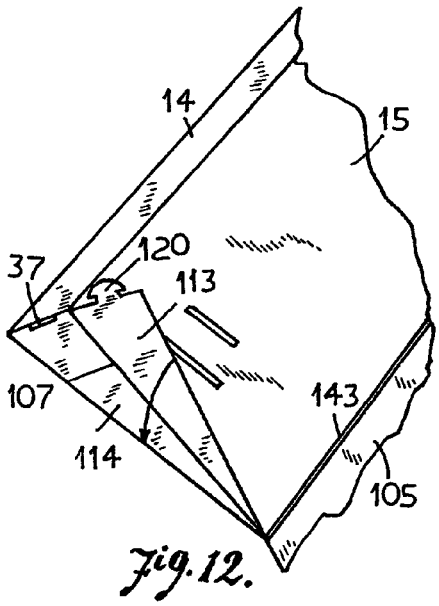
FIG. 12 is an isolated enlarged perspective front elevation view of the top left portion of the configuration showing how the side extension portion is to be folded to form the final reinforced side wall with the same decoration or print all appearing on the outer surface of the platforms and the side walls.
Figure 13:
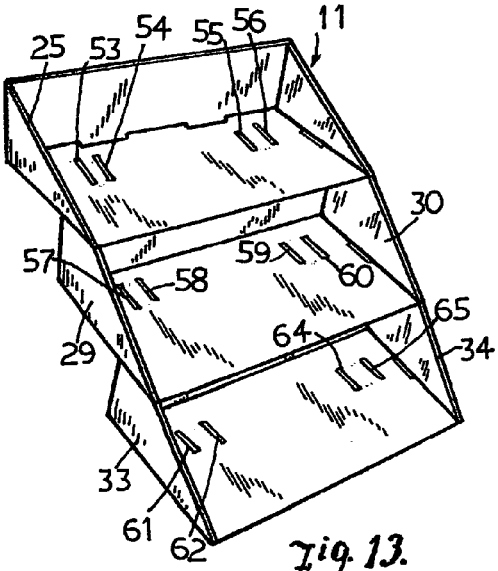
FIG. 13 is a perspective front elevation view of a third embodiment of the display portion of the stand having reinforced platforms and side walls with different decorations and prints appearing on the platforms and side walls.

The shelving portion 11 of the display stand 10 of the second embodiment may be formed by first folding the first panel 14 upwards relative to the second panel 15 along the horizontal fold line 20 until they are perpendicular to each other. The extension portion 25 and 26 are folded upwards relative to the panel 15 until the triangular portions 114 and 116 are perpendicular to the panel 15 with the upper edge of the triangular portions 114 and 116 now facing rearward to abut with the side edges 38 and 41 respectively. The reinforcing side panels 107 and 108 are then folded forwards as shown in FIG. 11 to cover over the triangular portions 114 and 116 respectively. The vertical slots 37 and 40 engage with the rectangular cut outs 119 and 121 to provide two vertical side mounting openings now facing sideways from the rear edge of the folded reinforcing side panels 107 and 108. The triangular portions 113 and 117 may then be folded outwards along the fold lines 115 and 118 as best shown in FIG. 12 to wrap over the already folded reinforcing side panels 107 and 108 and they may be mounted in place by bending the mounting tabs 120 and 122 to insert into the two vertical side mounting openings so as to provide the reinforced side walls 25 and 26 for panel 15.

The reinforcing panel 105 may now be folded upwards relative to the panel 15 along the horizontal fold line 143 until it lies juxtaposed to the front portion of the undersurface of the panel 15 to provide reinforcement to the upper shelve of the display.

After the upper shelve has been formed as described above, the panel 16 is folded downwards relative to the reinforcing panel 105 along horizontal fold line 21 until panels 16 and 105 are perpendicular to one another. The panel 17 is then folded upwards relative to the panel 16 along horizontal fold line 22 until panels 16 and 17 are perpendicular to one another so that the panel 16 forms the vertical rear wall and the panel 17 formed the platform respectively of the second shelve of the display 10. The reinforced side wall of the second shelve are formed by first folding the triangular portions 123 and 126 of the side extension of the panel 17 upwards relative to the panel 17 along vertical fold lines 45 and 48 respectively until the triangular portions 123 and 126 are perpendicular to the panel 17 and their rear edges are in abutment with the now vertical panel 16. The openings 43 and 46 now form two mounting openings along the rear edges of the second shelve. The reinforcing side panels 109 and 110 are then folded forwards to lie juxtaposed to the outer surface of the triangular portions 123 and 126 respectively and the cut outs 129 and 137 at the upper edges of the triangular portions 123 and 126 are aligned with the openings 43 and 46 respectively. The reinforced side walls of the second shelve are finally formed by folding the trapezoidal portions 124 and 127 downwards to wrap over the reinforcing side panels 109 and 110 respectively and the trapezoidal portions 124 and 127 are secured in the place by bending the mounting tabs 130 and 132 inwards to engage with the side openings 43 and 46 respectively.

The reinforcing panel 106 is then folded upwards relative to the panel 17 until it lies juxtaposed to the front portion of the under-surface of the panel 17 to provide the reinforcement for the second shelve of the display.

The lower shelve may now be formed in the manner similar to the second shelve by first folding the panel 18 forwards relative to the reinforcing panel 106 along the horizontal fold line 145 until they are perpendicular to one another and the panel 18 will be positioned vertically to form the rear wall of the lower shelve. The panel 19 is then folded forwards relative to the panel 18 along horizontal fold line 24 until they are perpendicular to one another. The triangular portions 133 and 138 of the side extensions of panel 19 are folded upwards along fold lines 63 and 66 respectively until they are perpendicular to the panel 19 and their rear edges contact the side edges of the panel 19. The reinforcing panels 111 and 112 are folded forwards to lie in contact with the outside surface of the triangular portions 133 and 138 respectively and the openings 49 and 51 aligned with the cut outs 136 and 141 respectively form two side mounting openings at the rear edge of the shelve. The trapezoidal portions 134 and 139 are folded along fold lines 135 and 140 respectively to wrap over the reinforcing panels 111 and 112 respectively and they are secured in place by bending the mounting tabs 137 and 142 to engage with the side openings 49 and 51.

The reinforcing shelving 11 is mounted to the support base 12 in the manner similar to the first embodiment described above. Since all exposed surfaces of the shelving of this embodiment are formed by the same front surface of the shelving configuration provided on the cardboard, decorative material such as print or color may be simply provided on the single front surface of the configuration.

Figure 14:
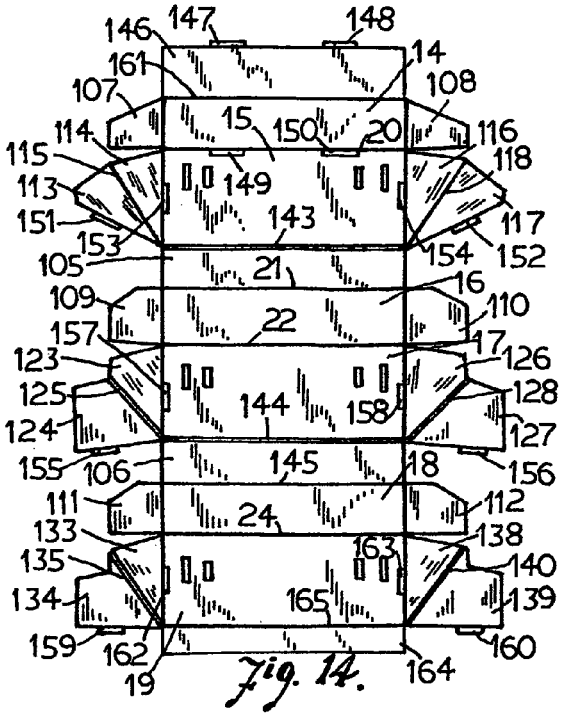
FIG. 14 is a perspective front elevation view of the configuration formed on a single cardboard for forming the display shelves of the third embodiment of FIG. 13 with reinforced platforms and side walls having different decorations and prints on their outer visible surfaces.
Figure 15:
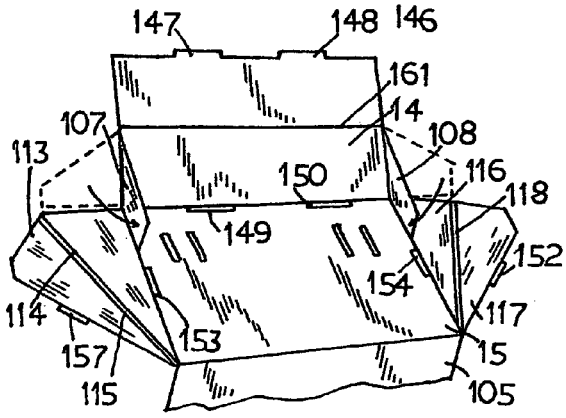
FIG. 15 is an isolated perspective elevation view of the top portion of the shelving showing the third embodiment with parts partially folded in the formation of the side walls.

A third embodiment of the shelving portion 11 having full reinforcement of its various parts is shown in FIGS. 13 through 16. In this embodiment, A vertical reinforcement panel 146 is provided for reinforcing the panel 14 so as to form a reinforced vertical rear wall of the upper shelve of the shelving portion 11. The reinforcement panel 146 is formed in the configuration by an additional rectangular panel extending upwards from the upper edge 161 of the panel 14 as best shown in FIG. 14 so that the upper edge 161 provides a horizontal fold line between the reinforcing panel 146 and panel 14. Two mounting tabs 147 and 148 are formed at the upper free edge of the reinforcing panel 146. Two horizontal slot openings are formed in panel 15 along the horizontal fold line 20. Vertical slot openings 153, 154, 157, 158, 162 and 163 are formed in panels 15, 17 and 19 respectively along their side edges. Mounting tabs 151 and 152 are formed at the outer edge of the triangular portions 113 and 117 respectively of the side extension portions of the panel 15 and mounting tabs 155, 156, 159 and 160 are formed at the lower edge of the trapezoidal portions 124, 127, 134 and 139 respectively.

Figure 16:
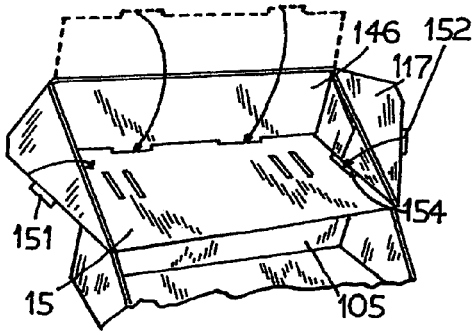
FIG. 16 is an isolated perspective elevation view of the top portion of the shelving portion showing the folding of the additional portion to form the final reinforced side wall of the third embodiment shown in FIG. 13.

The upper shelve of the third embodiment is formed by first folding the reinforcement panel 146 forwards along the horizontal fold line 161 until it lies in front and in contact with the panel 14 to form the reinforced rear wall of the upper shelve. The reinforcement panel 146 is maintained in place by engaging the mounting tabs 147 and 148 with the horizontal mounting openings 149 and 150 respectively in the panel 15 as best shown in FIG. 16. The panel 15 is then folded upwards relative to the panel 14 until the two panels 14 and 15 are perpendicular to one another. The reinforcing side panels 107 and 108 are folded forwards until they are perpendicular to both the panels 14 and 15 and are aligned with the side edges of the panel 15. The triangular portions 114 and 116 of the side extension portions of the panel 15 are folded upwards until they are in contact with the outer surface with the reinforcement side panels 107 and 108 respectively. The reinforced side walls of the upper shelve may then be formed by folding the triangular portions 113 and 117 inwards to wrap over the reinforcing side panels 107 and 108 respectively and they are secured in this mounted position by engaging the mounting tabs 151 and 152 with the vertical slot openings 153 and 154 respectively.

The reinforcing panel 105 is folded to lie underneath the front portion of the panel 15 similar to the second embodiment above to provide the reinforcement for the upper shelve.

The rear wall and the platform of the second shelve are formed by folding the panel 16 relative to reinforcing panel 105 to form its vertical rear wall and panel 17 relative to panel 16 to form its horizontal platform.

The reinforced side walls are formed by first folding the reinforcing side panels 109 and 110 forwards until they are perpendicular to both panels 16 and 17 and are aligned with the side edges of the panel 17 respectively. The triangular portions 123 and 126 are then folded upwards relative to the side edges of the panel 17 until they are in contact with the outer surface of the reinforcing side panels 109 and 110. The trapezoidal portions 124 and 127 are folded inwards to wrap over the reinforcing side panels 109 and 110 and they are secured in place by engaging the mounting tabs 155 and 156 with the mounting openings 157 and 158 respectively.

The horizontal reinforcing panel 106 is folded upwards until it lies in contact with the undersurface of the front portion of the panel 17 to provide the reinforcement of the second shelve.

The rear wall and the horizontal platform of the lower shelve are formed by folding the panel 18 relative to reinforcing panel 106 along horizontal fold line 145 and also by folding the panel 19 relative to panel 18 along fold line 24 similar to that in the second embodiment as described above.

The reinforced side walls of the lower shelve are formed in the manner similar to the side walls of the second shelve by first folding the reinforcing side panels 111 and 112 forwards until they are perpendicular to both panels 18 and 19 and are aligned with the side edges of the panel 19. The triangular portions 133 and 138 are folded upwards along the side edges of panel 19 until they lie in contact with the outer surface of the reinforcing side panels 111 and 112. The trapezoidal portions 134 and 139 are then folded inwards to wrap over the reinforcing side panels 111 and 112, and they are secured in place by engaging the mounting tabs 159 and 160 with the mounting openings 162 and 163 respectively.

An additional panel 164 is formed in the configuration extending outwards from the lower edge 165 of the panel 19. This additional panel 164 is folded downward until it lies underneath the front portion of the panel 19 and it may be secured to the panel 19 with adhesive so as to provide the reinforcement of the lower shelve.

While the present invention has been shown and described in the preferred embodiments thereof, it will be apparent that various modifications can be made therein without departing from the spirit and essential attributes thereof, and it is desired therefore that only such limitations be placed thereon as are imposed by the appended claims.

What is claimed is:

1. A foldable stepped display stand comprising:

a stepped shelving portion and a separate support base removably mounting to one another, said stepped shelving portion being formed by folding various parts of a configuration formed on a sheet material, and said configuration including a plurality of panels wherein adjacent panels are foldable relative to one another along common horizontal fold lines to form said shelving portion having horizontal shelves and vertical rear walls, side extension portions extending outwards from two side edges of each of said horizontal shelves and foldable along said side edges to form side walls perpendicular to both said horizontal shelves and said vertical rear walls, a pair of parallel retaining mounting slots formed adjacent to each one of said side edges of said horizontal shelves, said support base having two opposite side walls of a step configuration and of a mirror image of one another, a rectangular rear wall and rectangular front wall, said rear wall having a larger vertical dimension than said front wall, a plurality of mounting tabs formed at stepped upper edges of said support base and adapted for engaging with said parallel retaining mounting slots of said horizontal shelves of said shelving portion for removably mounting said shelving portion on said support base.

2. A foldable stepped display stand according to claim 1 including a vertical fold line provided at a middle position of said mirror image opposite side walls of said support base whereby said side walls are foldable along said vertical fold line to transform said support base into a collapsed condition with said front wall juxtaposed to said rear wall.

3. A foldable stepped display stand according to claim 1 wherein said configuration has six rectangular panels including a first panel, a second panel, a third panel, a fourth panel, a fifth panel and a sixth panel, said first panel and said second panel being foldable relative to one another along a first horizontal fold line until perpendicular to one another to form rear wall and horizontal platform of a fist shelve, said second panel and said third panel being foldable relative to one another along a second horizontal fold line until perpendicular to one another to form a second shelve and said third panel with said fourth panel being foldable relative to one another along a third horizontal fold line until perpendicular to one another to form a second shelve, said fourth panel and fifth panel being foldable relative to one another along a fourth horizontal fold line until perpendicular to one another with said fifth panel and said sixth panel being foldable relative to one another along a fifth horizontal fold line until perpendicular to one another to form a lower shelve.

4. A foldable stepped display stand according to claim 3 wherein said side extension portions are generally triangular portions formed at said side edges of said second panel, said fourth panel and said sixth panel and said triangular portions having a mounting hook formed at an upper edge therein, and vertical mounting slots formed adjacent to said side edges of said first panel, said third panel and said fifth panel, said mounting hook of said triangular portions of said extension portions being operative to engage with said mounting slots when said extension portions are folded perpendicular to respective said panels.

* * * * *